US006086121A

United States Patent [19]

Buckland

[11] Patent Number: 6,086,121

[45] Date of Patent: Jul. 11, 2000

[54] ROD ROLLER SYSTEM FOR MULTI-POINT LATCH

[75] Inventor: Stuart Buckland, Colwall Nr Malvern, United Kingdom

[73] Assignee: Southco, Inc., Concordville, Pa.

[21] Appl. No.: 09/282,961

[22] Filed: Apr. 1, 1999

Related U.S. Application Data

[60] Provisional application No. 60/080,446, Apr. 2, 1998.

[51] Int. Cl.[7] ..... E05C 1/06

[52] U.S. Cl. ..... 292/34; 292/9; 292/40; 292/161; 292/DIG. 51; 292/DIG. 55

[58] Field of Search ..... 292/34, DIG. 53, 292/9, 23, 40, 36, 35, DIG. 54, DIG. 55, DIG. 51, DIG. 64, 337, 41, 143, 173, 167, DIG. 57, 161; 70/451, 466, 114, 115, 116, 103, 104, 105, 108, 130

[56] References Cited

U.S. PATENT DOCUMENTS

| | | | |
|---|---|---|---|
| 1,720,173 | 7/1929 | Fuchs | 292/161 |
| 3,498,658 | 3/1970 | Steenstra et al. | 292/167 |
| 3,561,803 | 2/1971 | Schlage | 292/15 |
| 3,792,885 | 2/1974 | Giardina et al. | 292/39 |
| 3,872,697 | 3/1975 | Wellekens | 70/370 |
| 3,953,061 | 4/1976 | Hansen et al. | 292/5 |
| 4,362,328 | 12/1982 | Tacheny et al. | 292/36 |
| 4,892,338 | 1/1990 | Weinerman et al. | 292/35 |
| 4,896,905 | 1/1990 | Lehr et al. | 292/5 |
| 5,481,889 | 1/1996 | Richard et al. | 70/118 |
| 5,722,269 | 3/1998 | Simon et al. | 70/208 |
| 5,887,915 | 3/1999 | Ramsauer | 292/160 |

FOREIGN PATENT DOCUMENTS

| | | | |
|---|---|---|---|
| 292665 | 11/1988 | European Pat. Off. | 292/34 |
| 2508099 | 9/1976 | Germany | 292/DIG. 51 |

OTHER PUBLICATIONS

Southco Handbook 48 NA, Section O.

*Primary Examiner*—B. Dayoan
*Assistant Examiner*—Clifford B. Vaterlaus
*Attorney, Agent, or Firm*—Paul and Paul

[57] ABSTRACT

A rod-roller latching system mounted on a panel secures the panel to the frame of an enclosure. The central latch rotates a pawl. Rods attach the pawl to remote latches. Two-part guides each having a mounting bracket and a bearing sleeve position the rods.

12 Claims, 3 Drawing Sheets

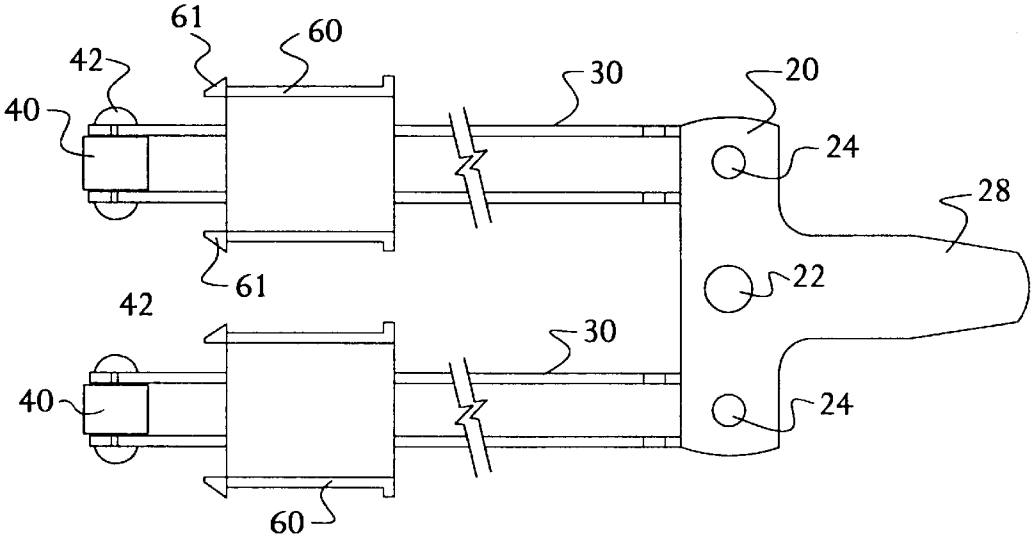
FIG. 7
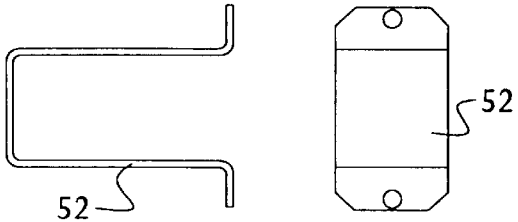
FIG. 6
FIG. 5
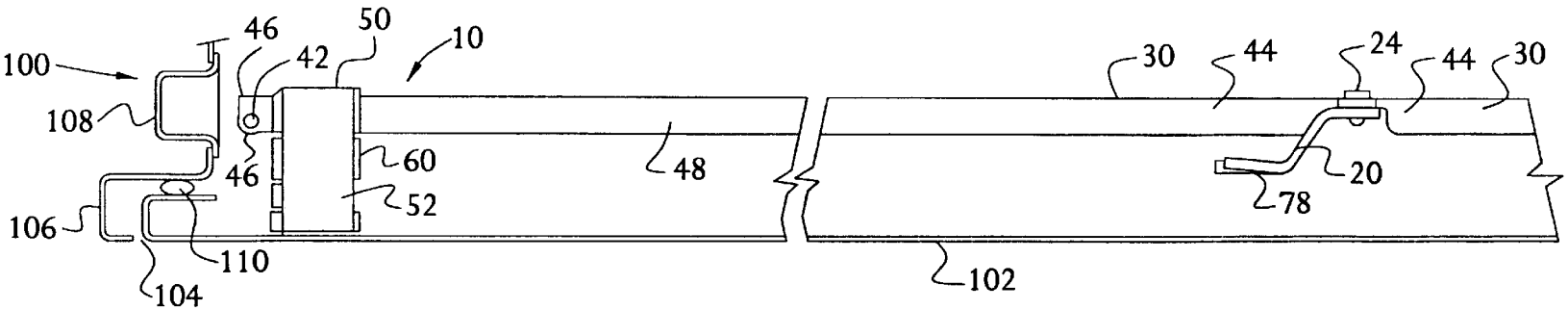
FIG. 4

ROD ROLLER SYSTEM FOR MULTI-POINT LATCH

CROSS-REFERENCE TO RELATED APPLICATION

This application claims the benefit of U.S. Provisional Application Ser. No. 60/080,446 filed Apr. 2, 1998, entitled "Rod-Roller System for Multi-Point Latch."

BACKGROUND OF THE INVENTION

1. Field of the Invention

The present invention relates generally to latching devices, and more particularly to systems for latching hinged doors or panels and the like at multiple points.

2. Brief Description of the Prior Art

Various types of latching devices for fastening doors, panels and the like are known.

In certain applications, such as in the case of doors or panels that need to be sealed when closed, multiple point latching systems are advantageously employed. In such systems, multiple latches are installed at or near the periphery of the door or panel to be sealed. The multiple latches can be individually actuated. However, it is a convenience if they are arranged to be actuated by a single central actuator. An example of a known multiple point actuating system is the VICE ACTION® 3-point compression system available from Southco, Inc., Concordville, Pa. In this system a pair of over-center latches are mounted on the door or panel to be secured, proximate the periphery. Often a compressible gasket will be provided between the door or panel and the corresponding frame or cabinet. A central operating latch is mounted in the panel between the over-center latches. The central operating latch, which can be rotated around an axis perpendicular to the plane of the panel, includes an actuator rod or plate which rotates when the latch is turned. The central operating latch also includes a handle or knob, which extends above the surface of the panel, or a fitting for a tool to be inserted for rotating the central operating latch. A pair of rods extend from the actuator plate to the over-center latches, so that as the central latch is rotated the over-center latches are each actuated, as the rods move in a plane parallel to the panel. The over-center action first latches, and then compresses the gasket, as the central latch is rotated, thereby both latching and sealing the panel against the frame.

In another type of multi-point latching system, the rod ends are fitted with rollers, and supported by rod guides mounted proximate the edge of the panel door. In the open position, the rods are retracted. When the panel door is closed, the latch actuator is rotated, and the rods are extended beyond the edge of the panel door and into engagement with a surface of the cabinet frame, thereby latching the panel to the cabinet.

There is a continuing need for a smoothly operating multi-point latch system which is easily operated, and which can readily secure an enclosure, such as an exterior enclosure for telecommunications equipment.

SUMMARY OF THE INVENTION

The present invention provides a rod-roller latching system adapted for mounting on a panel and securing the panel to a frame. The rod-roller latching system is strong, precise and easily operated, requiring a minimum of force by the operator thereof. The latching system is adapted to be operable by a central latch, and includes a pawl adapted for rotation by the central latch normal to the panel. The latching system also includes at least one remote latching means for securing the panel to the frame, as well as a respective rod means extending between the pawl and the at least one remote latching means such that the at least one remote latching means is operated when the pawl is rotated. In addition, the latching system includes at least one rod guide mounting assembly for positioning and guiding the action of a corresponding rod means. The rod guide mounting assembly includes a rod guide bearing sleeve for movably receiving a respective rod means, and a rod guide mounting bracket for securing the rod guide mounting assembly to the panel. Preferably, the bearing sleeve is formed from a material with a low coefficient of friction, such as with a static coefficient of friction of less than about 0.4. The bracket is adapted to receive and secure the respective rod guide bearing sleeve. Preferably, the rod guide bearing sleeve includes a plurality of tabs for mounting the rod guide bearing sleeve within the rod guide mounting bracket.

Preferably, the rod means has at least one channel formed therein proximate the rod guide mounting assembly, and the rod guide mounting assembly includes at least one guide means adapted to be received within the at least one channel for guiding the motion of the rod means when the latching system is actuated. It is also preferred that rod guide bearing sleeve have an aperture that is shaped to receive and support the rod means.

In a presently preferred embodiment, the rod means has a generally "U"-shaped cross-section forming a channel with a pair of opposed, generally parallel inner surfaces, and a pair of corresponding opposed outer surfaces. In this case the guide means has a pair of opposed, generally parallel surfaces, and the guide means is positioned proximate the opposed inner surfaces of the rod means when the rod means is received within the rod guide mounting assembly. Preferably, in this embodiment, the guide means further includes a pair of tabs extending into the aperture. Each of the respective tabs has a generally planar guide surface formed at the end of the respective tab, and each guide surface is positioned proximate one of the pair of opposed outer surfaces of the rod means when the rod guide is received within the rod guide mounting assembly.

Preferably, the rod guide bearing sleeve includes a plurality of tabs for mounting the rod guide bearing sleeve within the rod guide mounting bracket.

BRIEF DESCRIPTION OF THE DRAWINGS

FIG. 4 is a side elevational view of the rod roller system of FIG. 1.

FIG. 5 is side elevational view of a rod guide mounting bracket of the rod roller system of the present invention.

FIG. 6 is a top plan view of rod guide mounting bracket of FIG. 5.

FIG. 7 is a bottom plan view of the rod roller system of the present invention showing the rods linked to the actuator or pawl and having rod guide inserts mounted on the rods, prior to installation on a cabinet door.

DETAILED DESCRIPTION

The rod roller system of the present invention is intended for use with a central latching member to provide a multi-point latching system.

The present invention provides an improved rod roller system for securely and easily latching a cabinet door at one or more sites well removed from the central latching member.

Figure 1:
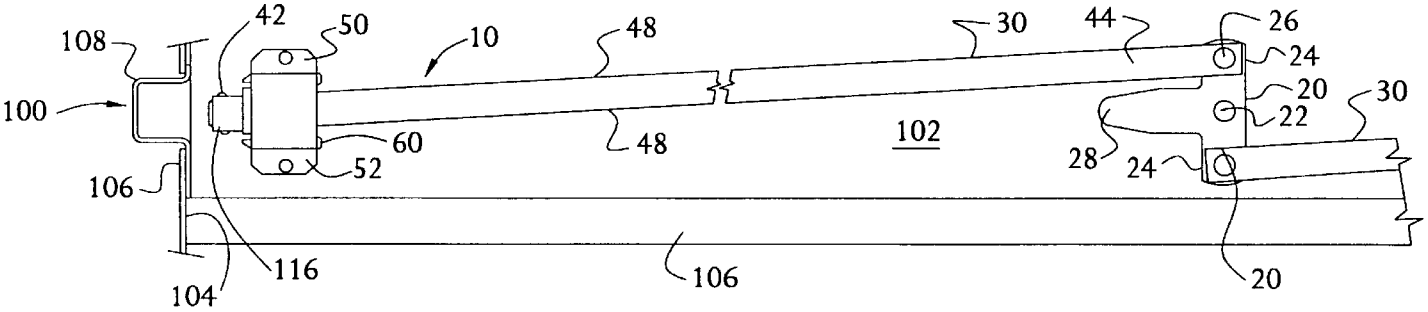
FIG. 1 is a top plan view showing a rod roller system of the present invention mounted on the door of a cabinet for securing the door to the frame of the cabinet, and depicting the rod roller system in a retracted or open position, as seen from inside the cabinet.

Referring now to the drawings in detail, wherein like reference numerals indicate like elements throughout the several views, there is shown in FIG. 1 a partial top plan view of a cabinet 100 having a rod roller system 10 of the present invention mounted on a door 102 thereof, as seen from inside the cabinet 100. The door 102 is mounted to the cabinet 100 by hinges (not shown) and covers an opening 104, the opening having the same general shape as the door 102, but being slightly smaller in size so that the door 102 extends beyond the opening 104 when the door 100 is closed. The portion of the cabinet 100 proximate the opening 104 serves as a frame 106 for the door 102. In addition, pockets 108 for use with the rod roller system 10 of this invention are formed in the cabinet 100 adjacent the door opening 104. A gasket 110 made from a compressible material is affixed on the underside of the door 102 proximate the periphery thereof to help seal the cabinet 100 when the door 102 is closed. The cabinet 100 and door 102 may be fabricated from any suitable material (e.g. steel) for enclosing various equipment (not shown) installed therein.

Figure 2:
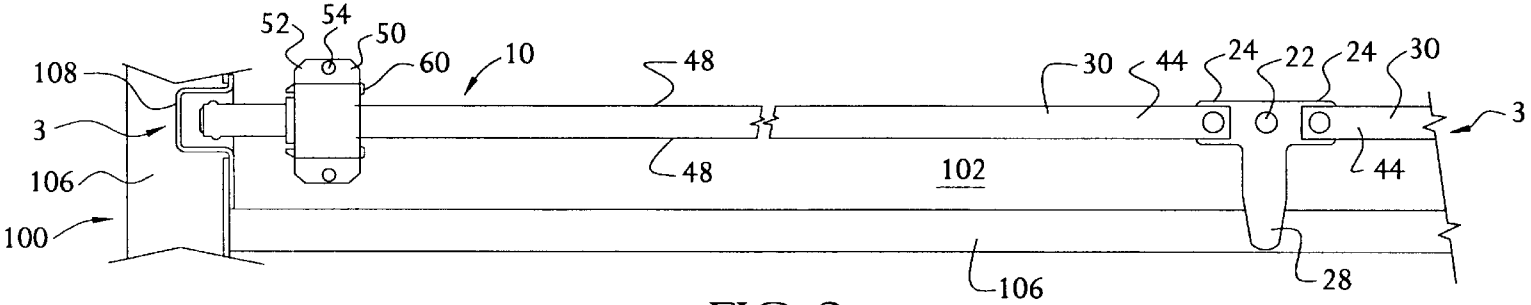
FIG. 2 is a top plan view of the rod roller system of FIG. 1 depicting the rod roller system in a closed and latched position.
Figure 3:
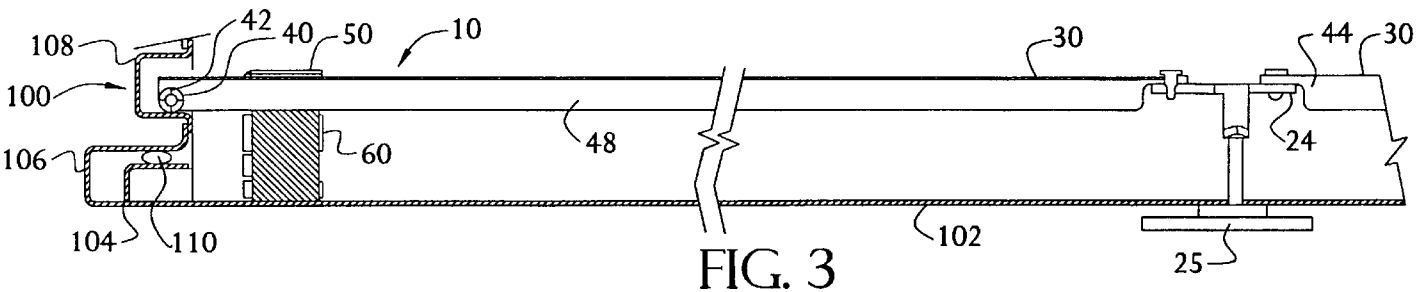
FIG. 3 is a side elevational sectional view of the rod roller system of FIG. 2 taken along the line 3—3 of FIG. 2.

The rod roller system 10 is adapted to be operable by rotation of central operating member or latch 25 (FIG. 3). The rod roller system 10 includes a generally "T"-shaped pawl 20 formed from a strong, durable material such as steel, and having an oblong central mounting aperture 22 for affixing the pawl 20 to the central latch 25, such that operation of the central latch causes the pawl 20 to rotate through a ninety degree angle between an open or unlatched position and a closed or latched position. The pawl 20 has a pair of opposed arms 24 to which are rotatably affixed by rivet means 26 a pair of actuator rods 30. The pawl 20 also includes a third arm 28 which extends below the common plane of the opposed arms 24 (best seen in FIG. 3) for directly engaging the underside of the frame 106 when the rod roller system 10 is in the closed or latched position (FIGS. 2 and 3) in order to help secure the door 102 to the cabinet frame 106.

The rod actuators 30 are preferably formed from a strong, light-weight material such as aluminum or aluminum alloy. The rod actuators 30 can include a channel provided therein, or preferably can be formed from channel stock. The channel sides 48 are cut away at one end 44 of each of the rod actuators 30 so that the opposed arms 24 of the pawl 20 can freely pivot through a full ninety-degree angle.

At the opposite ends 46 of each of the rod actuators 30 a roller 40 is rotatably mounted on a respective pin 42, the rotational axis of the roller 40 lying in a plane parallel to the cabinet door 102. The corners of the actuator rod sides 48 at the ends of the actuator rods 30 are rounded, and the rollers 40 are sized and positioned in the actuator rod ends so that the rollers 40 protrude slightly beyond the ends 46 and beneath the sides 48 of the actuator rods 30. When the rod roller system 10 is rotated from an open or retracted position (FIGS. 1 and 4) to a closed or engaged position (FIGS. 2 and 3), the rollers 40 engage the pockets 108 formed in the frame 106 of the cabinet 100 for that purpose, thereby pressing the door 102 against the frame 106 and compressing the gasket 110 therebetween. The rollers 40 are preferably formed from a strong, low friction material such as nylon.

The actuator rod ends 46 are positioned for this task on the door 102 by rod guide assemblies 50. Each rod guide assembly 50 includes a generally "U"-shaped mounting bracket 52 secured to inside of the door 102 by suitable fasteners 54. Each rod guide assembly 50 also includes a rod guide insert or bearing sleeve 60 preferably formed from a strong, material having a low frictional coefficient, such as a static coefficient of friction of less than about 0.4, for example, nylon. The bearing sleeve 60 is adapted to snap in place within the mounting bracket 52 for quick assembly by means of a plurality of snap-tabs 61 formed in the sides and top thereof. The mounting bracket 52 is thus adapted to receive and secure the respective bearing sleeve 60.

Figure 8:
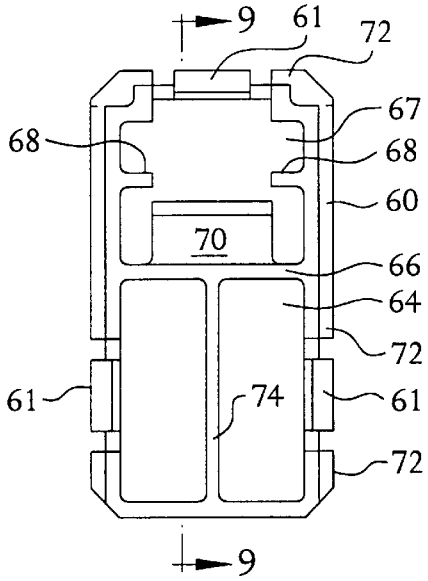
FIG. 8 is a front elevational view of a rod guide insert of the rod roller system of the present invention.
Figure 9:
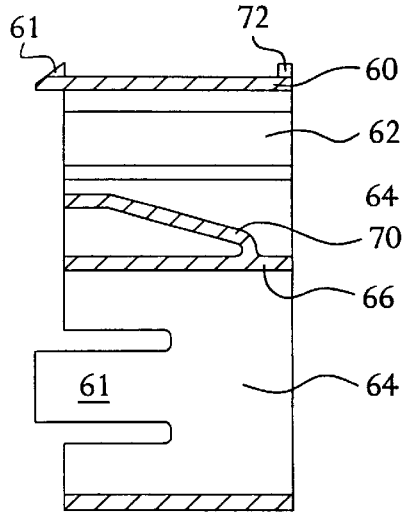
FIG. 9 is a side elevational sectional view of the rod guide insert of FIG. 8 taken along the line 9—9 of FIG. 8.
Figure 10:
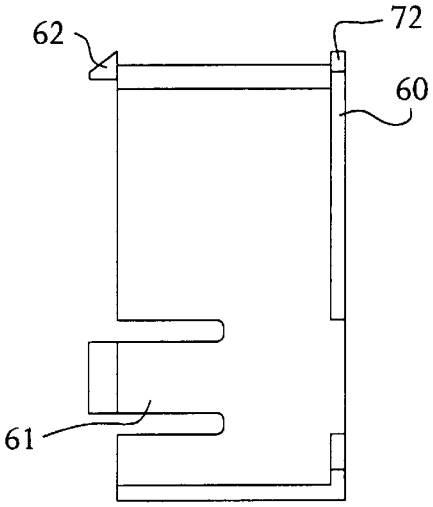
FIG. 10 is a side elevational view of the rod guide insert of FIG. 8.
Figure 11:
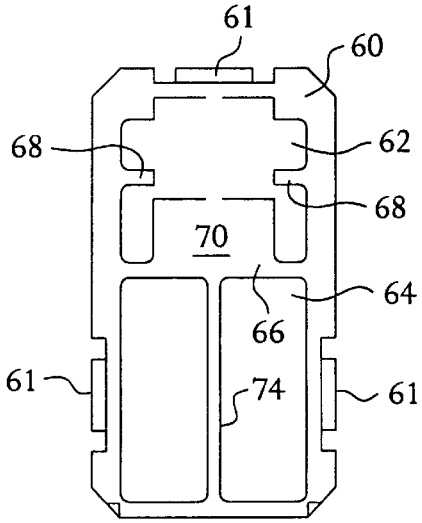
FIG. 11 is a rear elevational view of the rod guide insert of FIG. 8.
Figure 12:
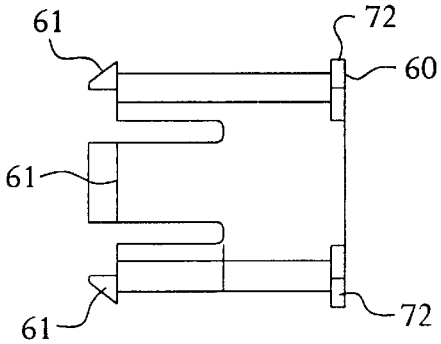
FIG. 12 is a top plan view of the rod guide insert of FIG. 8.
Figure 13:
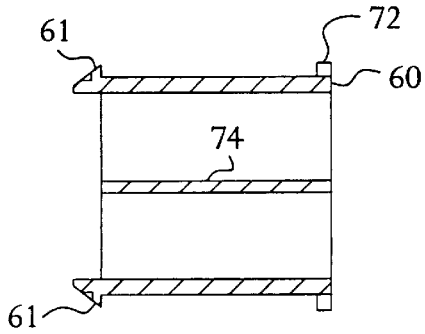
FIG. 13 is a bottom plan view of the rod guide insert of FIG. 8.

As best seen in FIGS. 8, 9 and 11, the bearing sleeve 60 includes an upper compartment 62 adapted to receive the actuator rod 30 and a lower compartment 64, the upper compartment or aperture 62 and the lower compartment 64 being separated by a generally horizontal support wall 66. The upper compartment 62 is shaped to receive and support the actuator rod 30. The height of the upper compartment 62 is selected so that the interior surfaces of the top and bottom thereof will guide the motion of the rod actuator 30 when the rod roller system 10 is operated. The upper compartment 62 includes an opposed pair of generally horizontal guide walls 68 sized and positioned for aligning the exterior surfaces of the sides 48 of the actuator rod 30 when the rod roller system 10 is being operated. The upper compartment 62 also includes a generally planar, generally horizontal interior guide wall 70 extending from the upper surface of the horizontal support wall 66 proximate the rear of the bearing sleeve 60 upwardly and forwardly within the upper compartment 62 to proximate the front of the bearing sleeve 60 (best seen in FIGS. 8, 9, and 11). The interior guide means or wall wall 70 is adapted to extend between the interior surfaces of the sides 48 of the actuator rod 30 and guide the motion of the actuator rod 30 when the rod roller system 10 is being operated. A flange 72 is formed on the exterior surfaces of the top and sides of the bearing sleeve 60 at the rear thereof, so that the bearing sleeve 60 will be securely held between the flange 72 and the snap tabs 61 when the bearing sleeve 60 is introduced within the mounting bracket 52. The lower compartment 64 also includes a generally horizontal medial support wall 74 for providing strength and rigidity to the bearing sleeve 60.

In operation the rod actuators 30 move both (1) through the bearing sleeves 60, and (2) slightly laterally in a plane parallel to the cabinet door 102, as can been seen by comparing FIGS. 1 and 2. The rod roller system 10 of the present invention provides for such actuation motion, while at the same time advantageously providing strong support for the actuator rod ends 46 so that they may securely press the door 102 against the cabinet frame 106.

Various modifications can be made in the details of the various embodiments of the apparatus of the present invention, all within the scope and spirit of the invention and defined by the appended claims.

What is claimed is:

1. A rod-roller latching system adapted for mounting on a panel, the system being adapted to be operable by a central latch, the latching system comprising:

a) a pawl adapted for rotation by the central latch normal to the panel;

b) at least one remote latching means for securing the panel to the frame;

c) a respective rod extending between the pawl and the at least one remote latching means such that the at least one remote latching means is operated when the pawl is rotated; and d) at least one rod guide mounting assembly for positioning and guiding the action of a corresponding rod, the rod guide mounting assembly including (1) a rod guide bearing sleeve for movably receiving the respective rod, and (2) a rod guide mounting bracket for securing the rod guide mounting assembly to the panel, the bracket being adapted to receive and secure the respective rod guide bearing sleeve;

wherein the rod has at least one channel formed therein proximate the rod guide mounting assembly, and the rod guide mounting assembly includes at least one guide means adapted to be received within the at least one channel for guiding the motion of the rod when the latching system is actuated.

2. A rod-roller latching system according to claim 1 wherein the rod guide bearing sleeve has an aperture shaped to receive and support the rod.

3. A rod-roller latching system according to claim 2 wherein the rod has a generally "U"-shaped cross-section forming a channel with a pair of opposed, generally parallel inner surfaces, and a pair of corresponding opposed outer surfaces, and the guide means has a pair of opposed, generally parallel surfaces, the guide means being positioned proximate the opposed inner surfaces of the rod when the rod is received within the rod guide mounting assembly.

4. A rod-roller latching system according to claim 3 wherein the guide means further includes a pair of tabs extending into the aperture, each of the respective tabs having a generally planar guide surface formed at the end of the respective tab, each guide surface being positioned proximate one of the pair of opposed outer surfaces of the rod when the rod guide is received within the rod guide mounting assembly.

5. A rod-roller latching system according to claim 1 wherein the rod guide bearing sleeve includes a plurality of tabs for mounting the rod guide bearing sleeve within the rod guide mounting bracket.

6. A rod-roller latching system according to claim 1 wherein the bearing sleeve is formed from a material with a low coefficient of friction.

7. A rod-roller latching system according to claim 6 wherein the bearing sleeve is formed form a material with a static coefficient of friction of less than about 0.4.

8. A rod-roller latching system adapted for mounting on a panel and securing the panel to a frame, the system being adapted to be operable by a central latch, the latching system comprising:

a) a pawl adapted for rotation by the central latch normal to the panel;

b) at least one remote latching means for securing the panel to the frame;

c) a respective rod extending between the pawl and the at least one remote latching means such that the at least one remote latching means is operated when the pawl is rotated;

d) at least one rod guide mounting assembly for positioning and guiding the action of a corresponding rod, the rod guide mounting assembly including (1) a rod guide bearing sleeve for movably receiving a respective rod, rod guide bearing sleeve having an aperture shaped to receive and support the rod and (2) a rod guide mounting bracket for securing the rod guide mounting assembly to the panel, the bracket being adapted to receive and secure the respective rod guide bearing sleeve;

the rod having at least one channel formed therein proximate the rod guide mounting assembly and the rod guide mounting assembly including at least one guide means adapted to be received within the at least one channel for guiding the motion of the rod when the latching system is actuated;

the rod means having a generally "U"-shaped cross-section forming a channel with a pair of opposed, generally parallel inner surfaces, and a pair of corresponding opposed outer surfaces, and the guide means having a pair of opposed, generally parallel surfaces, the guide means being positioned proximate the opposed inner surfaces of the rod when the rod is received within the rod guide mounting assembly.

9. A rod-roller latching system according to claim 8 wherein the guide means further includes a pair of tabs extending into the aperture, each of the respective tabs having a generally planar guide surface formed at the end of the respective tab, each guide surface being positioned proximate one of the pair of opposed outer surfaces of the rod when the rod guide is received within the rod guide mounting assembly.

10. A rod-roller latching system according to claim 8 wherein the rod guide bearing sleeve includes a plurality of tabs for mounting the rod guide bearing sleeve within the rod guide mounting bracket.

11. A rod-roller latching system according to claim 8 wherein the bearing sleeve is formed from a material with a low coefficient of friction.

12. A rod-roller latching system according to claim 11 wherein the bearing sleeve is formed form a material with a static coefficient of friction of less than about 0.4.

* * * * *